US007997763B2

(12) United States Patent
Giardina et al.

(10) Patent No.: US 7,997,763 B2
(45) Date of Patent: Aug. 16, 2011

(54) MULTI-HEAT SINK LED DEVICE

(75) Inventors: Richard N. Giardina, Erie, PA (US); G. James Deutschlander, Erie, PA (US); Brian S. Fetscher, Erie, PA (US); Andrey Y. Sadchikov, Erie, PA (US); Henrick A. Zabawski, Arlington Heights, IL (US)

(73) Assignee: Heatron, Inc., Leavenworth, KS (US)

( * ) Notice: Subject to any disclaimer, the term of this patent is extended or adjusted under 35 U.S.C. 154(b) by 326 days.

(21) Appl. No.: 12/414,690

(22) Filed: Mar. 31, 2009

(65) Prior Publication Data

US 2010/0246178 A1 Sep. 30, 2010

(51) Int. Cl.
*F21V 21/00* (2006.01)
*F21V 29/00* (2006.01)
*H01J 9/24* (2006.01)

(52) U.S. Cl. ..... 362/249.02; 362/294; 362/373; 362/274; 362/288; 362/311.02

(58) Field of Classification Search ..... 362/249.02, 362/274, 288, 294, 311.02, 373
See application file for complete search history.

(56) References Cited

U.S. PATENT DOCUMENTS

| | | | | |
|---|---|---|---|---|
| 5,219,221 | A * | 6/1993 | Yamaka et al. | 362/294 |
| 7,748,876 | B2 * | 7/2010 | Zhang et al. | 362/373 |
| 7,758,214 | B2 * | 7/2010 | Lee et al. | 362/294 |
| 7,874,702 | B2 * | 1/2011 | Shuai et al. | 362/294 |

* cited by examiner

*Primary Examiner* — Stephen F Husar
*Assistant Examiner* — James W Cranson
(74) *Attorney, Agent, or Firm* — Rankin, Hill & Clark LLP

(57) ABSTRACT

A light emitting diode (LED) lighting device that includes a housing and a heat sink assembly received within the housing. The heat sink assembly includes at least a first heat sink member and at least a second heat sink member. A printed circuit board having at least one LED provided thereon is mounted to both the first heat sink member and the second heat sink member. At least one biasing member biases an outer side of the first heat sink member and an outer side of the second heat sink member into contact with an inner side of the housing. Heat from the at least one LED is transferred through the heat sink assembly to the housing, where it is dissipated into the air.

21 Claims, 3 Drawing Sheets

MULTI-HEAT SINK LED DEVICE

BACKGROUND OF INVENTION

1. Field of Invention

The present invention relates to a lighting device and, more particularly, to a high-power light emitting diode (LED) lighting device with enhanced thermal management and a method of fabricating the same.

2. Description of Related Art

One of the key advantages of LED-based lighting is that it exhibits a higher efficiency in terms of light output per unit power input as compared to traditional incandescent lighting. Moreover, recent advances in LED-based lighting technology now make it possible for LED-based lighting to exhibit higher efficiency in such terms than standard fluorescent lighting. LED-based lighting is also less prone to damage due to vibration and has a longer service life.

Generally speaking, high-power LED's are required for general lighting applications. In the present specification and in the accompanying claims, the phrase "high-power LED" means an LED that is capable of continuous use at greater than or equal to one watt (≧1 W) of electrical power. It is often necessary to use two or more high-power LED's in an array to provide the desired light output.

The use of high-power LED's presents a problem. Unlike incandescent lighting sources, which radiate much of their energy as heat and are thus capable of operating at high temperatures, high-power LED's need to operate within a relatively narrow temperature range. And, because high-power LED's do not have perfect light-emission efficiency in converting electrical energy to light energy, some of the supplied electrical power is converted into heat. This heat, if not properly dissipated, can increase the operating temperature of the high-power LED, which can significantly alter and/or permanently degrade the operating characteristics of the high-power LED. There are four critical characteristics of a high-power LED that are affected by its operating temperature:

First, it is known that the operating temperature of an LED is inversely proportional to the energy bandgap, and that the energy bandgap is inversely proportional to the wavelength of light emitted from the LED. Accordingly, as the operating temperature of the high-power LED increases, the energy bandgap becomes narrower, and thus the wavelength of the emitted light increases. Therefore, when a high-power LED experiences an increase in its operating temperature, the wavelength of the light may increase by several nanometers. This phenomenon is called "a color shift". Consequently, when the heat generated by the high-power LED is not efficiently dissipated away from the device, light of the desired color cannot be obtained due to the color shift by the high-power LED.

Second, the brightness efficiency of light emitted from a high-power LED decreases as the operating temperature of the high-power LED increases.

Third, a high operating temperature accelerates a permanent reduction in light output from the LED referred to as lumen degradation. This reduction in light output is caused by degradation of the packaging materials and lattice changes in the epilayer of the die (which is also sometimes referred to in the art as an "LED chip").

Fourth, high operating temperatures decrease the overall reliability of the device due primarily to thermal stress from thermal coefficient of expansion ("TCE") mismatches between the LED die and packaging materials.

While the effects of improperly managed operating temperatures on the first two critical characteristics of a high-power LED are generally considered to be temporary, the last two critical characteristics affected by improperly managed operating temperatures are permanent. Thus, it is essential to dissipate heat from high-power LED lighting devices.

BRIEF SUMMARY OF THE INVENTION

The present invention is directed to a high-power LED lighting device with enhanced thermal management and a method of installing the same. A lighting device according to the invention comprises a housing and a heat sink assembly received within the housing. The heat sink assembly comprises at least a first heat sink member and at least a second heat sink member. A printed circuit board is mounted to both of the first heat sink member and the second heat sink member. At least one high-power LED is provided on the printed circuit board. The lighting device according to the invention further comprises at least one and preferably a plurality of biasing members that bias an outer side of the first heat sink member and an outer side of the second heat sink member into contact with an inner side of the housing. Heat from the high-power LED is transferred through the heat sink assembly to the housing, where it is dissipated into the air.

The present invention also provides a method for manufacturing a lighting device according to the invention. The method comprises:

inserting a heat sink assembly comprising a first heat sink member and a second heat sink member into a housing;

inserting at least one biasing member between the first heat sink member and the second heat sink member to bias an outer side of the first heat sink member and an outer side of the second heat sink member into contact with an inner side of the housing; and securing a printed circuit board comprising at least one high-power LED to both of the first heat sink member and the second heat sink member.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

Figure 1:
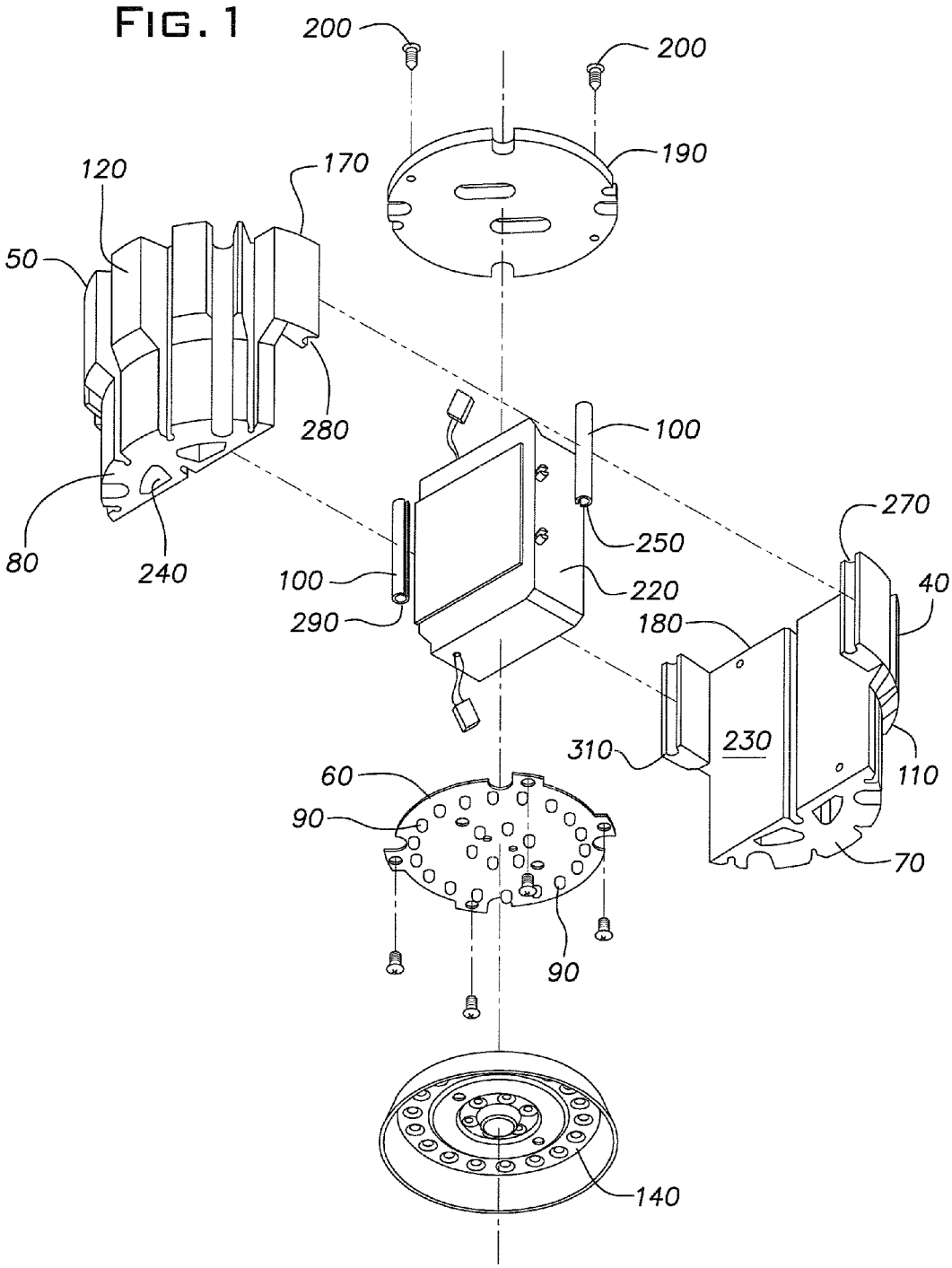
FIG. 1 is an exploded perspective view of a portion of a preferred embodiment of a lighting device according to the invention.
Figure 2:
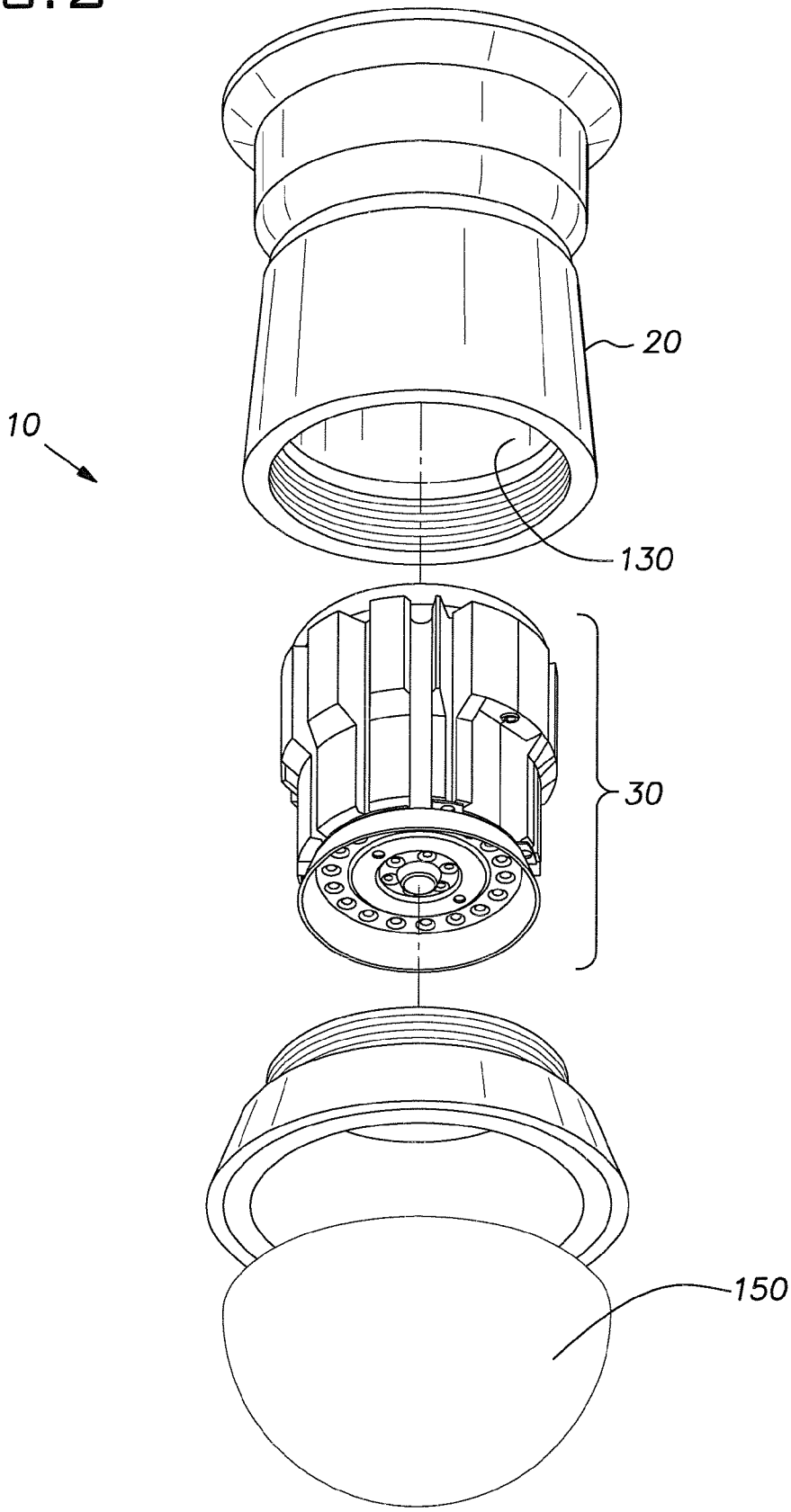
FIG. 2 is a perspective view showing additional components of the lighting device shown in FIG. 1.

With reference to FIGS. 1 and 2, a lighting device 10 according to the invention comprises a housing 20 and a heat sink assembly 30 received within the housing 20. The heat sink assembly 30 comprises a first heat sink member 40 and a second heat sink member 50. A printed circuit board 60 is secured to both a connecting portion 70 of the first heat sink member 40 and to a connecting portion 80 of the second heat sink member 50. At least one high-power LED 90 is provided on the printed circuit board 60. In some embodiments, a plurality of high-power LED's 90 are provided on the printed circuit board 60 such that the plurality of high-power LED's 90 are capable of continuous use of ≧1 W of electrical power. The lighting device 10 further comprises at least one biasing member 100, which biases an outer side 110 of the first heat sink member 40 and an outer side 120 of the second heat sink member 50 into contact with an inner side 130 of the housing 20.

Preferably, the lighting device further comprises an optic 140 mounted to the printed circuit board 60 for the at least one high-power LED 90. An optic 140 can be used to shape or direct the beam of light emitted from the at least one high-power LED 90.

The lighting device 10 preferably further comprises a lens 150. The lens 150 is operatively associated with the housing 20 and covers the at least one high-power LED 90. The lens 150 protects the printed circuit board 60 and other components within the housing 20 from dust and debris. The lens 150 can optionally be reinforced by a metal cage, if desired, or as may be required for use in specific applications.

Figure 3:
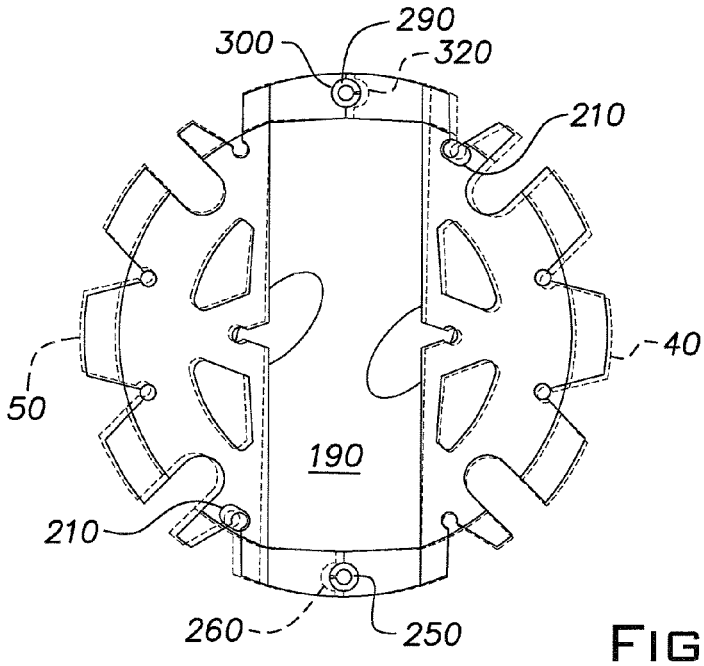
FIG. 3 depicts a heat sink assembly being pivotally biased by a biasing member.

With reference to FIG. 3, an end 170 of the first heat sink member 40 opposite to the connecting portion 70 of the first heat sink member 40 and an end 180 of the second heat sink member 50 opposite to connecting portion 80 of the second heat sink member 50 can be pivotally secured to an adapter plate 190. Throughout the present specification and in the appended claims, the phrase "pivotally secured" means that the first heat sink member 40 and the second heat sink member 50 can pivot on a pin or fastener 200 such that the biasing member 100 pivotally biases one or both of the outer sides 110, 120 of the first and second heat sink members 40, 50 into contact with the inner side 130 of the housing 20. The dashed lines in FIG. 3 show the first and second heat sink members 40, 50 pivotally biased away from an unbiased condition, which is shown in solid lines.

Figure 4:
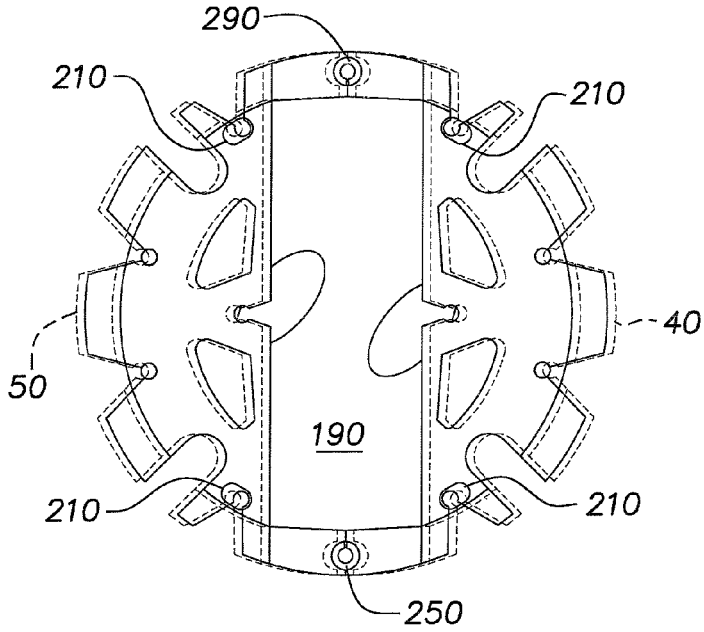
FIG. 4 depicts a heat sink assembly being slidably biased by a biasing member.

In an alternate configuration shown in FIG. 4, the first heat sink member 40 and the second heat sink member 50 are provided with slots 210, which slidably engaged with a pin or fastener 200 that extends from adapter plate 190. The biasing member 100 thus slidably biases one or both of the outer sides 110, 120 of the first and second heat sink members 40, 50 into contact with the inner side 130 of the housing 20. The dashed lines in FIG. 4 show the first and second heat sink members 40, 50 slidably biased away from an unbiased condition, which is shown in solid lines.

It will be appreciated that the first and second heat sink members 40, 50, do not need to be aligned on or with respect to pins or fasteners 200. Alternatively, a feature such as a groove or ledge could be formed on the inner side of the housing, which would align with a flange or rib extending from the heat sink members. The biasing member 100 would thus press the outer sides 110, 120 of the first and second heat sink members 40, 50 into contact with the inner side 130 of the housing 20, with the aligned groove and flange maintaining the orientation of the heat sink members and housing. The opposite configuration is also possible (i.e., the heat sink members are provided with a groove or ledge, and the inner side of the housing is provided with a flange or rib).

It will be appreciated that the adapter plate 190 is optional, and that the pins or fasteners 200 on which the first and second heat sink members 40, 50 are pivotally or slidably arranged could be installed in or integrally formed as part of the housing 20. Further optional components can include, for example, one or more alignment plates, which can assist in properly aligning the first and second heat sink members 40, 50 within the housing 20.

In the embodiment shown in FIGS. 1 and 2, an AC to DC driver 220 for the printed circuit board 60 and at least one high-power LED 90 assembly is secured to an inner side 230 of one of the first heat sink member 40 or the second heat sink member 50. AC current from an AC power source is connected on an input side of the AC to DC driver 220, and DC output wires associated with an output side of the AC to DC driver 220 make electrical connection to the printed circuit board 60 and thereby power the at least one high-power LED 90.

In the preferred embodiment of the invention, the first heat sink member 40 and the second heat sink member 50 are formed of a thermally conductive material such as aluminum, which can be cast, extruded or machined. The outer sides 110, 120 are adapted to contact the inner side of the housing, when the first and second heat sink members 40, 50 are in a biased condition. Heat from the at least one high-power LED 90 provided on the printed circuit board 60 is thus able to migrate through the heat sink assembly 30 from the connecting portion 70, 80 of the first and second heat sink members 40, 50 to the outer sides 110, 120 and then to the housing 20 in contact therewith, where it is dissipated into the air. This allows the at least one high-power LED 90 to operate at the desired thermal temperature range, which limits color shift and minimizes temporary and permanent reductions in light output and efficiency. It will be appreciated that the outer sides 110, 120 of the first and second heat sink members 40, 50 may be "fluted" or "finned" such as depicted in FIGS. 1 and 2. In addition, air channels 240 may also be formed through the first and second heat sink member 40, 50 to improve the flow of heat to the housing 20. In the embodiment illustrated in FIGS. 1 and 2, the first heat sink member 40 and the second heat sink member 50 are identical. It will be appreciated that the first and second heat sink members 40, 50 could be asymmetric.

Thermal interface material ("TIM") can be applied to the sides of the first and second heat sink members 40, 50 and/or to the inner side 130 of the housing 20 to increase thermal transfer efficiency between the first and second heat sink members 40, 50 and the housing 20. Furthermore, TIM can be applied between the printed circuit board 60 and the connecting portions 70, 80 of the first and second heat sink members 40, 50, respectively, to improve thermal transfer efficiency between the printed circuit board 60 and the first and second heat sink members 40, 50. Any TIM can be used including, but not limited to, thermal greases, oils, phase change materials and films.

In the embodiments of the invention illustrated in FIGS. 1, 3 and 4, the biasing member 100 is a slotted spring pin 250, which is received in a conduit 260 defined by aligned grooves 270, 280 provided in the first heat sink member 40 and the second heat sink member 50, respectively. Preferably, a second slotted spring pin 290 is received in a second conduit 300 defined by aligned second grooves 310, 320 provided in the first heat sink member 40 and the second heat sink member 50. The slotted spring pins 250, 290 bias the outer sides 110, 120 of the first and second heat sink members 40, 50 into contact with the inner side 130 of the housing 20, as the first and second heat sink member 40, 50 pivot (as illustrated in FIG. 3) or slide (as illustrated in FIG. 4) on the pins or fasteners 200 extending from the adapter plate 190 (or the housing 20, when the optional adapter plate 190 is not present). The use of a biasing member 100 ensures that the outer sides 110, 120 of the first and second heat sink members 40, 50 remain in contact with the inner side 130 of the housing 20 notwithstanding thermal expansion and contraction. This is essential in order to maintain the flow of heat from the printed circuit board 60 to the housing 20.

Figure 5:
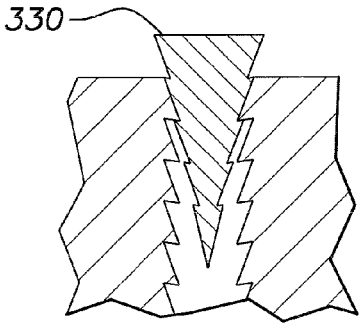
FIGS. 5 and 6 show alternative embodiments of biasing members according to the invention.
Figure 6:
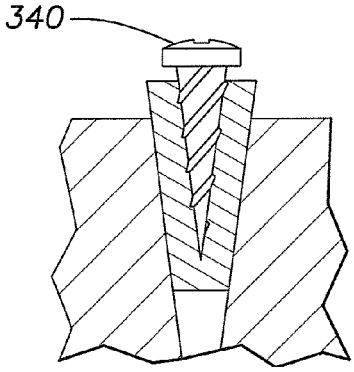

It will be appreciated that other types of biasing members 100 can be used instead of slotted spring pins 250, 290. For example and with reference to FIG. 5, the biasing member 100 could be a wedge 330, which is driven between the first heat sink member 40 and the second heat sink member 50 after the first heat sink member 40 and the second heat sink member 50 have been inserted into the housing 20. In yet another embodiment, which is illustrated in FIG. 6, the biasing member 100 could be an expansion screw 340, which expands between the first heat sink-member 40 and the second heat sink member 50 after the first heat sink member 40 and the second heat sink member 50 are inserted into the housing 20.

In the illustrated embodiment of the invention, two biasing members of the same size are utilized. It should be appreciated that two or more biasing members, each having a different size and/or type, could be utilized. Similarly, the grooves within which such biasing members are received could also be of different size and/or configuration. It will also be appreciated that the heat sink assembly could comprise more than two heat sink members and more than two biasing members, if desired (e.g., three heat sink members and three biasing members).

In another aspect, the present invention provides a method for manufacturing a lighting device. The method comprises:

inserting a heat sink assembly comprising a first heat sink member and a second heat sink member into a housing;

inserting at least one biasing member between the first heat sink member and the second heat sink member to bias an outer side of the first heat sink member and an outer side of the second heat sink member into contact with an inner side of the housing; and securing a printed circuit board comprising at least one high-power LED to both of the first heat sink member and the second heat sink member.

The first and second heat sink members could be pivotally or slidably secured to an adapter plate, which is inserted with the first and second heat sink members and secured to the housing. Alternatively, the first and second heat sink members could be pivotally or slidably engaged with pins or fasteners extending from the housing.

Electrical connections can be made between the printed circuit board and the DC output side of the AC to DC driver using wires or harnesses extend from one or both thereof. The AC to DC driver can be secured to an inner side of one of the first heat sink member or the second heat sink member using fasteners.

Once the heat sink assembly has been biased against the housing, and the printed circuit board has been secured to the connecting portion of the heat sink assembly, an optic can be fastened to the printed circuit board using fasteners. It will be appreciated that depending upon the configuration of the optic, it may be possible to connect the optic to the printed circuit board before the printed circuit board is secured to the connecting portion of the first and second heat sink members. A lens is then preferably operatively associated with the housing for covering the at least one high-power LED. The lens can be reinforced with a metal cage, if desired.

The entire assembled unit can then be shipped to an installation site. The installer does not disconnect the lens from the housing, but merely electrically connects AC power from an AC power source to the input side of the AC to DC driver. When the lighting device fails, it is simply replaced with a new lighting device. The lighting device that failed can be returned to the factory to be reconditioned and returned to service, if desired.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A lighting device comprising:

a housing;

a heat sink assembly received within the housing, said heat sink assembly comprising a first heat sink member and a second heat sink member;

a printed circuit board secured to both of a connecting portion of the first heat sink member and a connecting portion of the second heat sink member;

at least one high-power LED provided on the printed circuit board; and a first biasing member, said first biasing member biasing at least one of an outer side of the first heat sink member or an outer side of the second heat sink member into contact with an inner side of the housing.

2. The lighting device according to claim 1 further comprising at least a second biasing member.

3. The lighting device according to claim 1 further comprising at least a third heat sink member.

4. The lighting device according to claim 1 further comprising an optic mounted to the printed circuit board for the at least one high-power LED.

5. The lighting device according to claim 1 further comprising a lens operatively associated with the housing for covering the at least one high-power LED.

6. The lighting device according to claim 1 wherein a plurality of high-power LED's are provided on the printed circuit board.

7. The lighting device according to claim 6 wherein, collectively, the plurality of high-power LED's are capable of continuous use of ≧1 W of electrical power.

8. The lighting device according to claim 1 wherein the first heat sink member and the second heat sink member are formed of cast, extruded or machined aluminum.

9. The lighting device according to claim 8 wherein the first biasing member is a slotted spring pin, and wherein said slotted spring pin is received in a conduit defined at least in part by aligned grooves provided in the first heat sink member and the second heat sink member.

10. The lighting device according to claim 9 further comprising a second slotted spring pin received in a second conduit defined at least in part by aligned second grooves provided in the first heat sink member and the second heat sink member.

11. The lighting device according to claim 1 further comprising an AC to DC driver secured to an inner side of one of the first heat sink member or the second heat sink member, the AC to DC driver having a DC output side electrically connected to the printed circuit board.

12. The lighting device according to claim 1 wherein the first heat sink member and the second heat sink member are pivotally engaged with an adapter plate.

13. The lighting device according to claim 1 wherein the first heat sink member and the second heat sink member are pivotally engaged with the housing.

14. The lighting device according to claim 1 wherein the first heat sink member and the second heat sink member are slidably engaged with an adapter plate.

15. The lighting device according to claim 1 wherein the first heat sink member and the second heat sink member are slidably engaged with the housing.

16. A lighting device comprising:

a housing;

a heat sink assembly received within the housing, said heat sink assembly consisting of a first heat sink member and a second heat sink member, said first heat sink member and said second heat sink member being formed of aluminum;

a printed circuit board secured to both of a connecting portion of the first heat sink member, and a connecting portion of the second heat sink member;

at least one high-power LED provided on the printed circuit board, said at least one high-power LED being capable of continuous use of ≧1 W of electrical power;

an optic mounted to the printed circuit board for the at least one high-power LED;

a pair of slotted spring pins, each of said slotted spring pins being received in a conduit defined by aligned grooves provided in the first heat sink member and the second heat sink member, said slotted spring pins biasing an outer side of the first heat sink member and an outer side of the second heat sink member into contact with an inner side of the housing; and a lens operatively associated with the housing for covering the at least one high-power LED.

17. A method for manufacturing a lighting device, the method comprising:

inserting a heat sink assembly comprising a first heat sink member and a second heat sink member into a housing;

inserting at least one biasing member between the first heat sink member and the second heat sink member to bias an outer side of the first heat sink member and an outer side of the second heat sink member into contact with an inner side of the housing; and securing a printed circuit board comprising at least one high-power LED to both of the first heat sink member and the second heat sink member.

18. The method according to claim 17 wherein the first heat sink member and the second heat sink member are pivotally engaged with an adapter plate that is inserted into the housing with the heat sink assembly.

19. The method according to claim 17 wherein the first heat sink member and the second heat sink member are pivotally engaged with the housing.

20. The method according to claim 17 wherein the first heat sink member and the second heat sink member are slidably engaged with an adapter plate that is inserted into the housing with the heat sink assembly.

21. The method according to claim 17 wherein the first heat sink member and the second heat sink member are slidably engaged with the housing.

* * * * *